US011358788B2

(12) United States Patent
Knudson

(10) Patent No.: US 11,358,788 B2
(45) Date of Patent: Jun. 14, 2022

(54) CONTAINER DOOR OPENING SYSTEM

(71) Applicant: Bart A. Knudson, Perham, MN (US)

(72) Inventor: Bart A. Knudson, Perham, MN (US)

( * ) Notice: Subject to any disclaimer, the term of this patent is extended or adjusted under 35 U.S.C. 154(b) by 0 days.

(21) Appl. No.: 16/937,039

(22) Filed: Jul. 23, 2020

(65) Prior Publication Data

US 2022/0024689 A1 Jan. 27, 2022

(51) Int. Cl.

| | |
|---|---|
| ***E05B 19/20*** | (2006.01) |
| ***B65D 90/66*** | (2006.01) |
| ***E05B 1/00*** | (2006.01) |
| ***B66F 15/00*** | (2006.01) |

(52) U.S. Cl.

CPC ..... *B65D 90/66* (2013.01); *B66F 15/00* (2013.01); *E05B 1/0053* (2013.01)

(58) Field of Classification Search

CPC ..... B65D 90/66; B66F 15/00; E05B 1/0053; E05B 83/10

USPC ..... 81/15.9, 484

See application file for complete search history.

(56) References Cited

U.S. PATENT DOCUMENTS

| | | | | |
|---|---|---|---|---|
| 6,131,712 | A * | 10/2000 | Rhodenizer | B60T 17/223 188/3 H |
| 6,279,418 | B1 * | 8/2001 | Olive, Jr. | G05G 5/18 248/354.6 |
| 6,745,653 | B2 * | 6/2004 | Kurtz | B25B 27/0035 254/DIG. 5 |
| 8,671,722 | B1 * | 3/2014 | Qi | B60R 25/0225 70/209 |
| 8,794,597 | B1 | 8/2014 | Ingesson | |
| 8,857,030 | B2 * | 10/2014 | Stutson, Jr. | B65D 90/00 29/426.5 |
| 9,003,928 | B2 | 4/2015 | Vigil | |
| 9,345,912 | B2 | 5/2016 | Wells | |
| 9,528,305 | B2 * | 12/2016 | Brammer, Jr. | E05B 1/0053 |
| 9,752,348 | B2 | 9/2017 | Leach | |
| 10,641,006 | B1 * | 5/2020 | Haile | E05B 1/0053 |
| 2007/0096473 | A1 | 5/2007 | Ortega | |
| 2014/0131644 | A1 | 5/2014 | Brown | |
| 2017/0044795 | A1 | 2/2017 | Nelson | |

* cited by examiner

*Primary Examiner* — Joseph J Hail
*Assistant Examiner* — Shantese L McDonald
(74) *Attorney, Agent, or Firm* — Neustel Law Offices

(57) ABSTRACT

A container door opening system for assisting in the opening and closing of rusted tight or stuck hinges on intermodal container doors. The container door opening system generally includes an elongated member having a movably first engaging member and a fixed second engaging member. The first engaging member is movable both towards and away from the second engaging member so as to adjust the effective distance between the engaging members. A bias member is connected to the first engaging member so as to bias the first engaging member away from the second engaging member. The first engaging member may be engaged with a first anchor point on a container door and the second engaging member may be engaged with a second anchor point on the container door. The elongated member may then be pivoted away from the door to open it or towards the door to close it.

20 Claims, 8 Drawing Sheets

CONTAINER DOOR OPENING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a container door opening system for assisting in the opening and closing of rusted tight or stuck hinges on intermodal container doors.

Related Art

Any discussion of the related art throughout the specification should in no way be considered as an admission that such related art is widely known or forms part of common general knowledge in the field.

Intermodal containers have been used for shipping various items such as freight for many decades. Such intermodal containers are typically large standardized shipping containers which are built for intermodal freight transport. Intermodal containers are transported by various transportation methods, such as but not limited to by train, by automobile (e.g., trucks), and by ship.

As should be expected, intermodal containers are subject to significant weather and other elements during use. For example, intermodal containers on ships are constantly exposed to sea water, rain, salt, wind, and the like. Similarly, intermodal containers on trains are exposed to various elements such as wind, rain, snow, and particulate materials such as dirt or the like.

With repeated exposure to the elements, it is no surprise that the doors of such intermodal containers can become wedged or stuck in a shut position. Hinges may become compromised by repeated exposure to particulate materials such as dirt and sand, or may become rusted by repeated exposure to water. The door itself may become jammed due to jostling in the sea or on land. In these cases, it can be extremely difficult to open the access door to such an intermodal container after it has been exposed to such significant elements.

SUMMARY

An example embodiment is directed to a container door opening system. The container door opening system includes an elongated member having a movably first engaging member and a fixed second engaging member. The first engaging member is movable both towards and away from the second engaging member so as to adjust the effective distance between the engaging members. A bias member is connected to the first engaging member so as to bias the first engaging member away from the second engaging member. The first engaging member may be engaged with a first anchor point on a container door and the second engaging member may be engaged with a second anchor point on the container door. The elongated member may then be pivoted away from the door to open it or towards the door to close it.

There has thus been outlined, rather broadly, some of the embodiments of the container door opening system in order that the detailed description thereof may be better understood, and in order that the present contribution to the art may be better appreciated. There are additional embodiments of the container door opening system that will be described hereinafter and that will form the subject matter of the claims appended hereto. In this respect, before explaining at least one embodiment of the container door opening system in detail, it is to be understood that the container door opening system is not limited in its application to the details of construction or to the arrangements of the components set forth in the following description or illustrated in the drawings. The container door opening system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
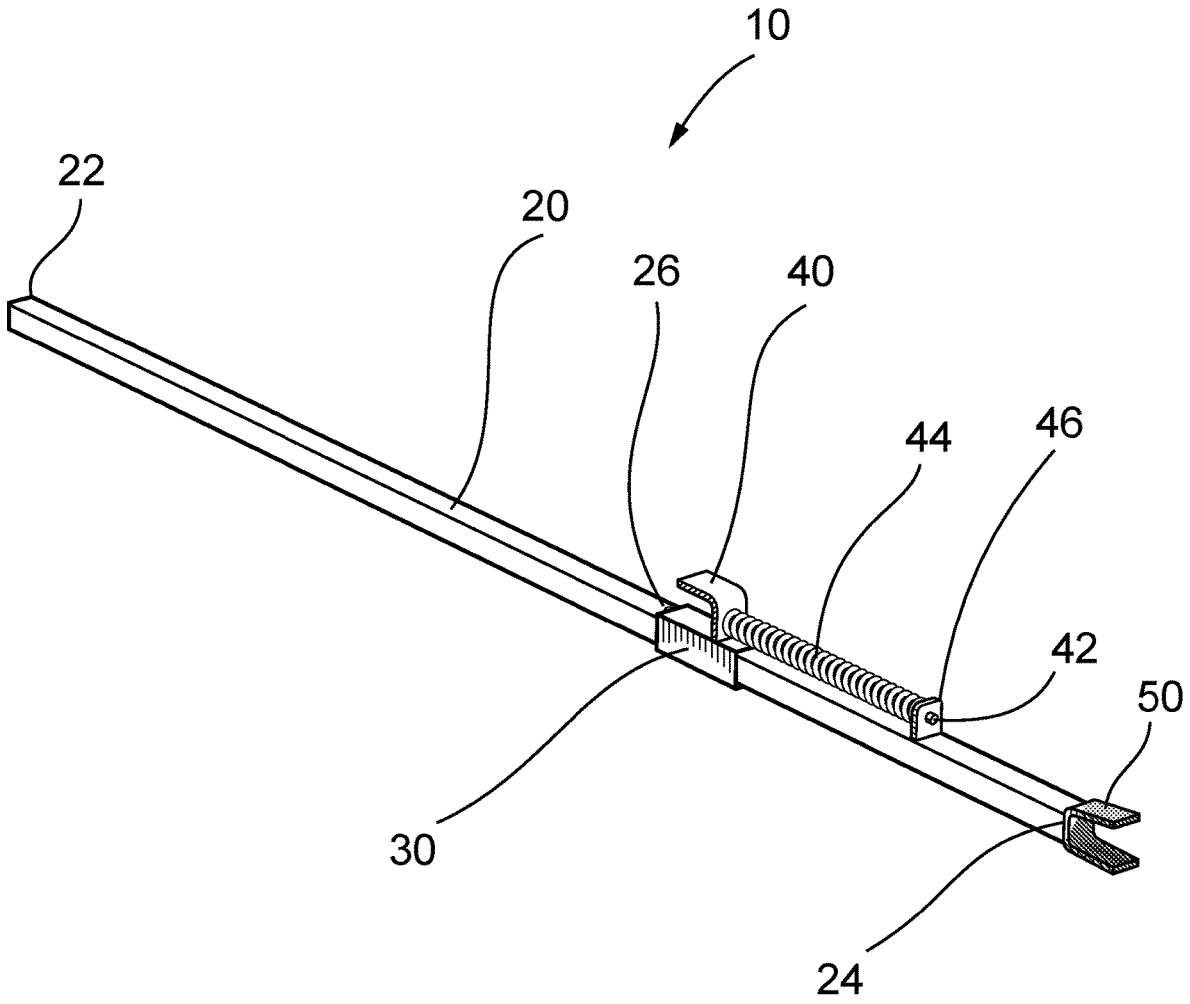
FIG. 1 is a perspective view of a container door opening system in accordance with an example embodiment.

An example container door opening system generally comprises an elongated member 20 comprising a first end 22 and a second end 24; a first engaging member 40 movably connected to the elongated member 20, wherein the first engaging member 40 is adjustable in a first direction towards the first end 22 of the elongated member 20 and in a second direction towards the second end 24 of the elongated member 20, wherein the first engaging member 40 is adjustable between a first position and a second position, wherein the first position is comprised of a retracted position and wherein the second position is comprised of an extended position; a second engaging member 50 connected at or near the second end 24 of the elongated member 20, wherein the first engaging member 40 is closer to the second engaging member 50 in the retracted position than in the extended position; a bracket 46 connected to the elongated member 20 between the first engaging member 40 and the second engaging member 50; and a bias member 44 connected between the bracket 46 and the first engaging member 40 so as to bias the first engaging member 40 towards the extended position, wherein the first engaging member 40 and the second engaging member 50 are each adapted to engage with a container door 12 so as to open or close the container door 12.

The bias member 44 may comprise a coiled spring. A rod 42 may be connected to the first engaging member 40, with the bias member 44 coiled around the rod 42. The bracket 46 may comprise an opening, wherein the rod 42 is slidably connected through the opening of the bracket 46. The rod 42 may extend through the opening of the bracket 46 when the first engaging member 40 is in the retracted position.

The first engaging member 40 may be oriented in a first direction and the second engaging member 50 may be oriented in a second direction. The first engaging member 40 may be oriented towards the first end 22 of the elongated member 20 and the second engaging member 50 may be oriented away from the first end 22 of the elongated member 20. The first engaging member 40 may comprise an L-shaped member such as an L-shaped jaw. The second engaging member 50 may comprise a U-shaped member such as a U-shaped jaw. The elongated member 20 may comprise a square-shaped cross section.

A method of opening a container door 12 is also disclosed, comprising the steps of: grasping the first end 22 of the elongated member 20; engaging the first engaging member 40 with a first anchor point 13*a* on the container door 12; pulling the elongated member 20 so as to retract the first engaging member 40 into the retracted position; aligning the second engaging member 50 with a second anchor point 13*b* on the container door 12; releasing the elongated member 20 so as to extend the first engaging member 40 into the extended position; engaging the second engaging member 50 with the second anchor point 13*b* on the container door 12; and pivoting the elongated member 20 away from the container door 12 so as to open the container door 12.

Another exemplary container door opening system 10 may comprise an elongated member 20 comprising a first end 22 and a second end 24; a connector 30 movably connected to the elongated member 20, wherein the connector 30 is movable towards and away from the second end 24 of the elongated member 20; a first engaging member 40 connected to the connector, wherein the first engaging member is adjustable between a first position and a second position, wherein the first position comprises a retracted position and wherein the second position comprises an extended position; a bracket 46 connected to the elongated member 20 between the connector 30 and the second end 24 of the elongated member 20; a bias member 44 connected between the bracket 46 and the first engaging member 40 so as to bias the first engaging member 40 towards the first end 22 of the elongated member 20; and a second engaging member 50 connected at or near the second end 24 of the elongated member 20, wherein the first engaging member 40 is closer to the second engaging member 50 in the retracted position than in the extended position; wherein the first engaging member 40 and the second engaging member 50 are each adapted to engage with a container door 12 so as to open or close the container door 12.

The first engaging member 40 may be adapted to engage with a first anchor point 13*a* on the container door 12 and the second engaging member 50 may be adapted to engage with a second anchor point 13*b* on the container door 12. The first anchor point 13*a* may comprise a first vertical pipe and the second anchor point 13*b* may comprise a second vertical pipe. The connector 30 may be comprised of a sleeve. The sleeve may completely surround the elongated member 20. The first engaging member 40 may be comprised of an L-shaped member oriented in a first direction and the second engaging member 50 may be comprised of a U-shaped member oriented in a second direction, wherein the first direction is opposite to the second direction.

A method of closing a container door 12 is disclosed, comprising the steps of: grasping the first end 22 of the elongated member 20; engaging the first engaging member 40 with a first anchor point 13*a* on the container door 12; pulling the elongated member 20 so as to retract the first engaging member 40 into the retracted position; aligning the second engaging member 50 with a second anchor point 13*b* on the container door 12; releasing the elongated member 20 so as to extend the first engaging member 40 into the extended position; engaging the second engaging member 50 with the second anchor point 13*b* on the container door 12; and pivoting the elongated member 20 towards the container door 12 so as to close the container door 12.

The systems and methods herein may be utilized to pry open or close a wide variety of access doors 12 of a wide variety of different containers 11. The figures illustrate an exemplary embodiment in which an access door 12 of a standard intermodal shipping container 11 is being opened/closed using an elongated member 20. It should be appreciated that various other types of containers 11 may be opened by the systems and methods described herein, and thus the containers 11 described herein should not be construed as limited to any particular shape, size, or configuration. Similarly, the shape, size, and configuration of the access door 12 of the container 11 may vary in different embodiments and thus should not be construed as limited by the exemplary embodiments shown and described herein.

B. Container Door Opener

As best shown in FIGS. 1-4, the container door opener system 10 includes an elongated member 20 which includes a first end 22 and a second end 24. The shape, size, and configuration of the elongated member 20 may vary in different embodiments, and thus should not be construed as limited by the exemplary figures. By way of a non-limiting example, one embodiment of the elongated member 20 may be longer in length for use with wider container doors 12. Another embodiment of the elongated member 20 may be shorter in length for use with narrower container doors 12.

The figures illustrate that the elongated member 20 may comprise an elongated beam, pole, post, rod, or the like. However, the shape and configuration of the elongated member 20 may vary in different embodiments. The figures illustrate that the elongated member 20 is linear and straight without any curves, bends, or the like. However, it should be appreciated that, in some embodiments, the elongated member 20 may include curves, bends, tapering, or the like.

It should be appreciated that the material used for the elongated member 20 may vary. In some embodiments, the elongated member 20 may be comprised of various metals, alloys, plastics, or the like, so long as the material of elongated member 20 exhibits sufficient strength not to bend, warp, buckle, or break when force is applied to pry open a container door 12 with the elongated member 20.

The figures illustrate that the elongated member 20 comprises a square-shaped cross-section. It should be appreciated that such a configuration is merely for illustrative purposes only, as the elongated member 20 could comprise various other cross-sections in different embodiments. By way of example and without limitation, the elongated member 20 could comprise a circular cross-section in some embodiments.

The first end 22 of the elongated member 20 is generally utilized as a handle for the elongated member 20. Thus, an operator 16 will typically grasp the elongated member 20 either at or near its first end 22 when the elongated member 20 is in use. During typical use, an operator 16 would place her first hand at or near the first end 22 of the elongated member 20 and her second hand in between the first end 22 of the elongated member 20 and the sleeve 30 such that the elongated member 20 may be pivoted about its second end 24.

It should be appreciated that an operator 16 may grasp anywhere along the length of the elongated member 20 when in use. For example, both hands could be placed at or near the first end 22 of the elongated member 20 when in use. The first end 22 of the elongated member 20 may include ergonomic features or a resilient covering material such as rubber, plastic, or the like to increase comfort the operator 16 when grasping the elongated member 20.

The second end 24 of the elongated member 20 will typically include a second engaging member 50 which is adapted to engage against an anchor point 13*b* on the container door 12. The figures illustrate that the second engaging member 50 is connected to the second end 24 of the elongated member 20, though in some embodiments the second engaging member 50 may be positioned at other locations. For example, the second engaging member 50 could be positioned inwardly from the second end 24 of the elongated member 20 in some embodiments.

As best shown in FIGS. 1-4, a first engaging member 40 is connected to the elongated member 20 such that the first engaging member 40 is movable along a portion of the length of the elongated member 20 between its first end 22 and its second end 24. The first engaging member 40 may be directly connected to the elongated member 20 or may be indirectly connected to the elongated member 20, such as by a connector 30 as is shown in FIGS. 1-4.

Figure 3:
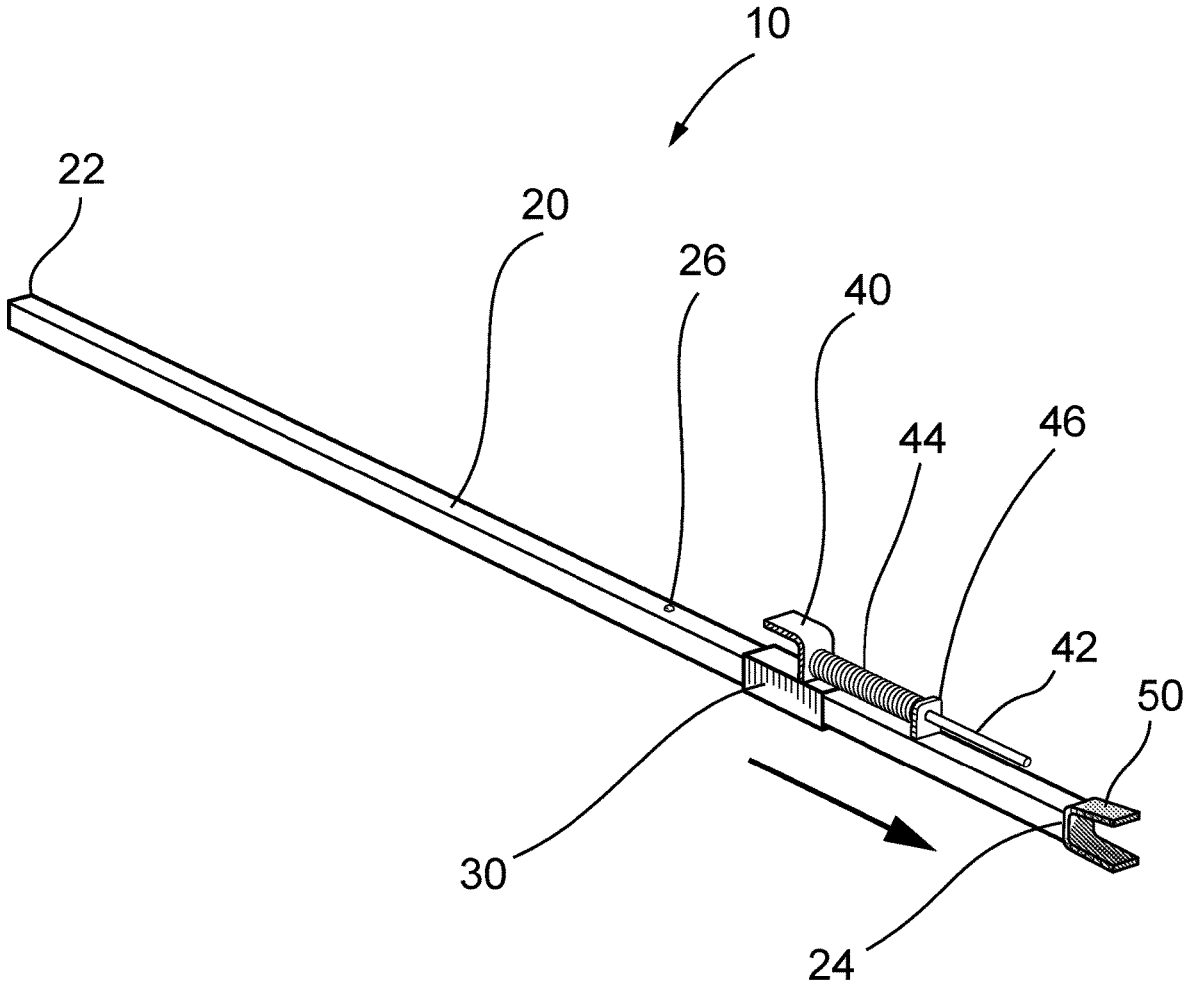
FIG. 3 is a perspective view of a container door opening system with the first engaging member in the retracted position in accordance with an example embodiment.
Figure 4:
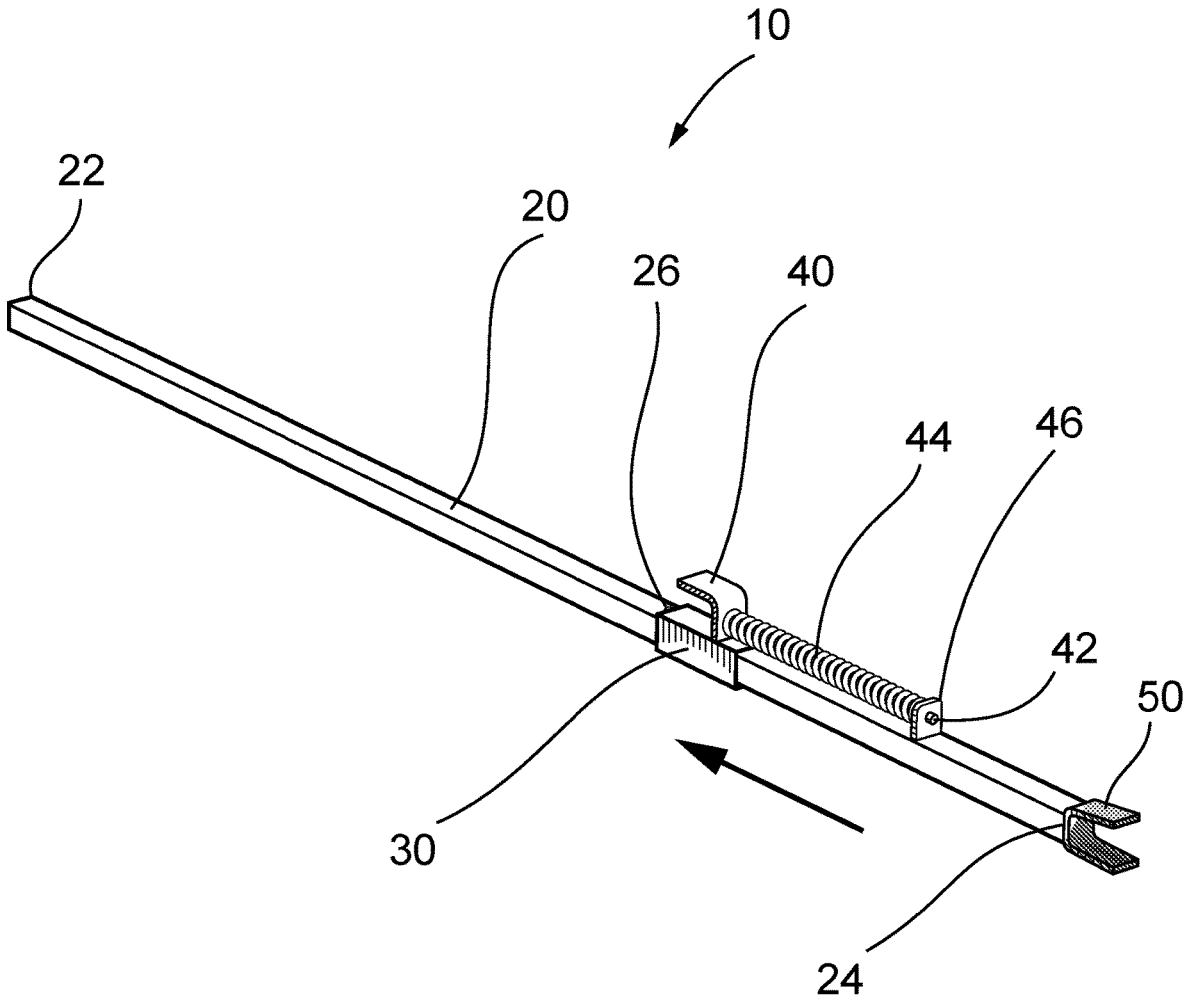
FIG. 4 is a perspective view of a container door opening system with the first engaging member in the resting position in accordance with an example embodiment.

As best shown in FIGS. 3 and 4, the first engaging member 40 is movably connected to the elongated member 20. In the exemplary embodiment shown in the figures, the first engaging member 40 is slidable along a portion of the length of the elongated member 20 between its first end 22 and its second end 24. The length of the elongated member 20 along which the first engaging member 40 may move (e.g., by sliding) may vary in different embodiments.

Generally, the first engaging member 40 may be movable along approximately 15% of the length of the engaging member 40, with the stopper 26 inhibiting movement of the engaging member 40 towards the first end 22 of the elongated member 20 and the bias member 44 inhibiting movement of the engaging member 40 towards the second end 24 of the elongated member 20. However, the first engaging member 40 may be movably along a greater or lesser length of the elongated member 20 in different embodiments.

The first engaging member 40 may be moved in both directions: in a first direction towards the first end 22 of the elongated member 20 and in a second direction towards the second end 24 of the elongated member 20. Movement in the first direction towards the first end 22 of the elongated member 20 is constrained may a stopper 26 positioned on the elongated member 20. The stopper 26 may comprise a raised projection such as a semi-spherical projection extending outwardly from the surface of the elongated member 20.

As best shown in FIGS. 1-4, the stopper 26 may be positioned along the length of the elongated member 20 between the first end 22 and the second end 24 of the elongated member 20. The stopper 26 is illustrated in FIG. 3 as being positioned on the upper side of the elongated member 20, though the stopper 26 may be positioned at any side of the elongated member 20 so long as the stopper 26 functions to prevent movement of the first engaging member 40 past the point of the stopper 26.

Although the figures illustrate that the stopper 26 is comprised of a semi-spherical projection, it should be appreciated that various other shapes and configurations could be utilized. By way of example and without limitation, the stopper 26 may comprise a square-shaped projection, a bracket, a cylindrical projection, or the like. The stopper 26 may be fixedly connected to the elongated member 20, or may be integrally formed therewith. In either case, the stopper 26 prevents movement of the first engaging member 40 past the point of the stopper 26 in the direction of the first end 22 of the elongated member 20.

The manner in which the first engaging member 40 is movably connected to the elongated member 20 may vary in different embodiments. In the exemplary embodiment shown in FIGS. 1-4, the first engaging member 40 is movably connected to the elongated member 20 by a connector 30. The connector 30 is itself movably connected to the elongated member 20, with the first engaging member 40 either being connected to the connector 30, or integrally formed therewith.

In the exemplary embodiment shown in the figures, the connector 30 is illustrated as comprising a sleeve which completely surrounds the elongated member 20. However, it should be appreciated that, in some embodiments, such as sleeve may not fully surround the elongated member 20. For example, the connector 30 could include a slot or other type of break in its surface. In any case, the connector 30 is movably connected to the elongated member 20 such that the connector 30 may freely slide or move along a portion of the length of the elongated member 20.

In the figures, the connector 30 is illustrated as comprising a sleeve which extends around the elongated member 20 and includes a square-shaped cross-section. It should be appreciated that other shapes may be utilized to suit the corresponding shape of the elongated member 20. For example, if the elongated member 20 were comprised of a cylindrical shape, the connector 30 may itself have a circular cross-section in some embodiments.

Movement of the connector 30 in the first direction towards the first end 22 of the elongated member 20 is inhibited by the stopper 26, which is positioned between the first end 22 of the elongated member 20 and the connector 30. When the connector 30 is pushed, pulled, or otherwise drawn towards the first end 22 of the elongated member 20, the stopper 26 will prevent movement past a certain point. This will ensure that the connector 30 does not slide off the first end 22 of the elongated member 20.

As shown in FIGS. 1-4, a bias member 44 may be included so as to bias the connector 30 (and thus the attached first engaging member 40) towards the first end 22 of the elongated member 20, where the first engaging member 40 is stopped by the stopper 26. Thus, the bias member 44 may be configured so as to force the first engaging member 40 and connector 30 against the stopper 26 absent force sufficient to overcome the bias force of the bias member 44. In this manner, the first engaging member 40 may be maintained in a rested, extended position when not in use.

The type of bias member 44 utilized may vary in different embodiments. Generally, different types of linear springs or actuators may be utilized to provide the bias force against the first engaging member 40. In the exemplary embodiment shown in the figures, the bias member 44 is illustrated as comprising a spring. More specifically, the bias member 44 is shown as comprising a coiled spring which is coiled around a rod 42. However, various other types of springs may be utilized, including but not limited to compression springs, extension springs, torsion, springs, constant force springs, Belleville springs, drawbar springs, volute springs, garter springs, flat springs, gas springs, and air springs. In some embodiments, the bias member 44 may comprise an actuator, such as a linear actuator.

In the exemplary embodiment shown in FIGS. 1-4, the bias member 44 is connected between the first engaging member 40 and a bracket 46, with the bracket 46 being connected to or integral with the elongated member 20 at a position between the stopper 26 and the second end 24 of the elongated member 20. The bracket 46 may comprise a tab-like structure which extends outwardly from the elongated member 20, with an opening being positioned in the center of the bracket 46 in which a rod 42 may be movably inserted.

The bracket 46 may comprise various configurations, shapes, and sizes. In the exemplary embodiment shown in the figures, the bracket 46 is illustrated as comprising a square-shaped tab which extends outwardly from the elongated member 20 and includes a central opening through which the rod 42 extends. In other embodiments, the bracket 46 could comprise any structure to which the bias member 44 may be secured.

As shown in FIGS. 3 and 4, the rod 42 is connected to the first engaging member 40 at its first end. The second end of the rod 42 is connected to and inserted within the bracket 46. When the first engaging member 40 is pushed, pulled, or drawn towards the second end 24 of the elongated member 20, the rod 42 is pushed along with the first engaging member 40 such that the rod 42 extends through the bracket 46 such as shown in FIG. 3. The bias member 44 coiled around the rod 42 is compressed between the first engaging member 40 and the bracket 46 such that, upon release of force, the first engaging member 40 is forced back to its resting, extended position by the bias force applied by the bias member 44 against the first engaging member 40.

Figure 2:
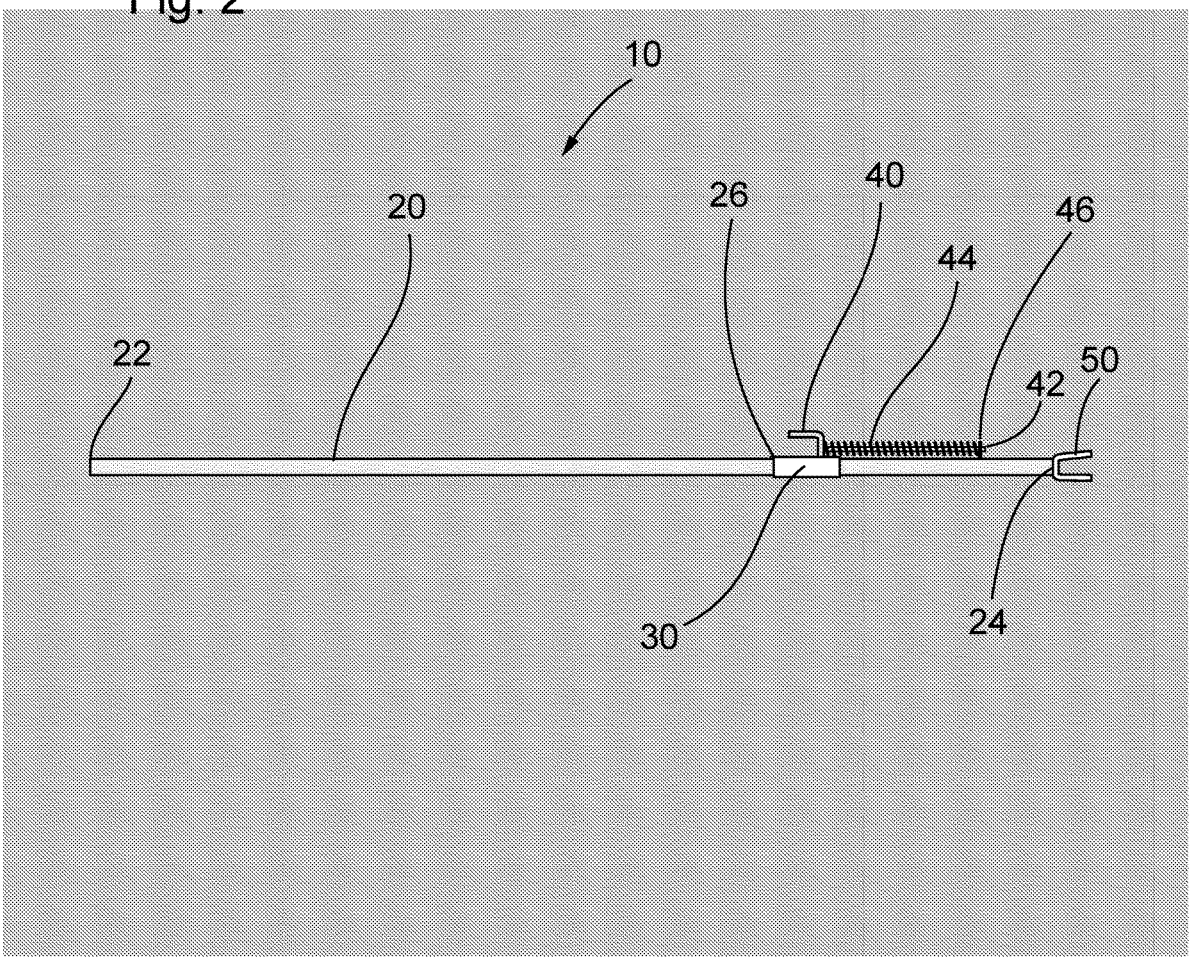
FIG. 2 is a side view of a container door opening system in accordance with an example embodiment.

Generally, when the first engaging member 40 is in its rested, extended position towards the first end 22 of the elongated member 20, the distal end of the rod 42 will be flush against the bracket 46 such as shown in FIGS. 1, 2, and 4. When the first engaging member 40 is in its retracted position towards the second end 24 of the elongated member 20, the distal end of the rod 42 extends through the bracket 46 a distance such as shown in FIG. 3, with the bias member 44 such as a coil spring being compressed around the rod 42 so as to revert the first engaging member 40 back to its rested, extended position absent the application of force.

The bracket 46 is generally positioned a distance from the stopper 26, with the bracket 46 being connected to the elongated member 20 between the stopper 26 and the second end 24 of the elongated member 20. By way of example, the bracket 46 could be positioned at the approximate mid-point between the second end 24 of the elongated member 20 and the stopper 26. In other embodiments, the bracket 46 could be positioned closer to the stopper 26, or in yet other embodiments, the bracket 46 could be positioned closer to the second end 24 of the elongated member 20.

The rod 42 is fixedly secured to the first engaging member 40 such as shown in the figures. The distal end of the rod 42 extends through the bracket 46, but is otherwise not connected to any structure. Thus, the rod 42 may move with the first engaging member 40. When the first engaging member 40 is moved towards the second end 24 of the elongated member 20, the rod 42 moves with the first engaging member 40 by sliding within the bracket 46. When the first engaging member 40 is adjusted into its retracted position, the rod 42 extends through the bracket 46 such as shown in FIG. 3. The rod 42 is generally parallel with respect to the elongated member 20.

The bias member 44 is connected around the rod 42 such as shown in FIGS. 1-4. For example, the bias member 44 may comprise a spring which is coiled around the rod 42, with the bias member 44 being sandwiched between the first engaging member 40 on its first end and the bracket 46 on its second end. The bias member 44 is compressed against the bracket 46 when the first engaging member 40 is moved towards the second end 24 of the elongated member 20, with the bias member 44 thus inhibiting and stopping movement of the first engaging member 40 past a certain point towards the second end 24 of the elongated member 20. Releasing force against the first engaging member 40 will cause the bias member 44 to decompress, thus forcing the first engaging member 40 back towards the first end 22 of the elongated member 20 to be stopped against the stopper 26.

As shown throughout the figures, the elongated member 20 includes a first engaging member 40 and a second engaging member 50. The first engaging member 40 is movably connected along the length of the elongated member 20 such that the first engaging member 40 may be moved towards or away from the first end 22 of the elongated member 20. Thus, the first engaging member 40 may be moved in a first direction towards the first end 22 of the elongated member 20 into an extended or resting position. In such a position, the first engaging member 40 rests against the stopper 26 and is prevented from being moved any further towards the first end 22 of the elongated member 20, such as shown in FIGS. 1, 2, and 4.

Similarly, the first engaging member 40 may be moved in a second direction towards the second end 24 of the elongated member 20 into a retracted position. In such a position, the first engaging member 40 is drawn towards the second engaging member 50, thus reducing the distance between the pair of engaging members 40, 50. When being moved in the second direction, the first engaging member 40 encounters resistance force from the bias member 44 being pressed against the bracket 46. Eventually, the force will be impossible to overcome, thus restricting movement of the first engaging member 40 past a certain point in the second direction.

As the first engaging member 40 is moved towards the second engaging member 50, the bias member 44 is compressed between the first engaging member 40 and the bracket 46 such as shown in FIG. 3. Compression of the bias member 44 serves to both stop movement of the first engaging member 40 in the second direction past a certain point, and to impart a bias force against the first engaging member 40 such that the first engaging member 40 will return to its original, resting (extended) position once force is released from the first engaging member 40.

The first engaging member 40 may comprise various shapes, sizes, and configurations. In the exemplary embodiment shown in the figures, the first engaging member 40 comprises an L-shaped member which is connected to the connector 30, with the L-shaped member being oriented towards the first end 22 of the elongated member 20. In some embodiments, the first engaging member 40 may comprise a hook or similar structure adapted to anchor onto an anchor point 13*a* on the container door 12, such as a vertical pipe which is common on such container doors 12. Although the figures illustrate the first engaging member 40 as being comprised of an L-shaped member, it should be appreciated that other shapes may be utilized.

The second engaging member 50 is generally positioned at or near the second end 24 of the elongated member 20. The second engaging member 50 is a fixed member in contrast to the first engaging member 40 which is a movably member. The second engaging member 50 may be connected to the elongated member 20 or may be integrally formed therewith. The second engaging member 50 may be connected to the distal end of the second end 24 of the elongated member 20, or may be offset with respect to the second end 24 of the elongated member 20 in some embodiments.

The second engaging member 50 may comprise various shapes, sizes, and configurations. In the exemplary embodiment shown in the figures, the second engaging member 50 is comprised of a U-shaped member which is connected to the second end 24 of the elongated member 20, with the U-shaped member being oriented towards the second end 24 of the elongated member 20. In some embodiments, the second engaging member 50 may comprise a hook or similar structure adapted to anchor onto an anchor point 13*b* on the container door 12, such as a vertical pipe or the like which is common on such container doors 12. Although the figures illustrate the second engaging member 50 as being comprised of a U-shaped member, it should be appreciated that other shapes may be utilized.

Figure 8:
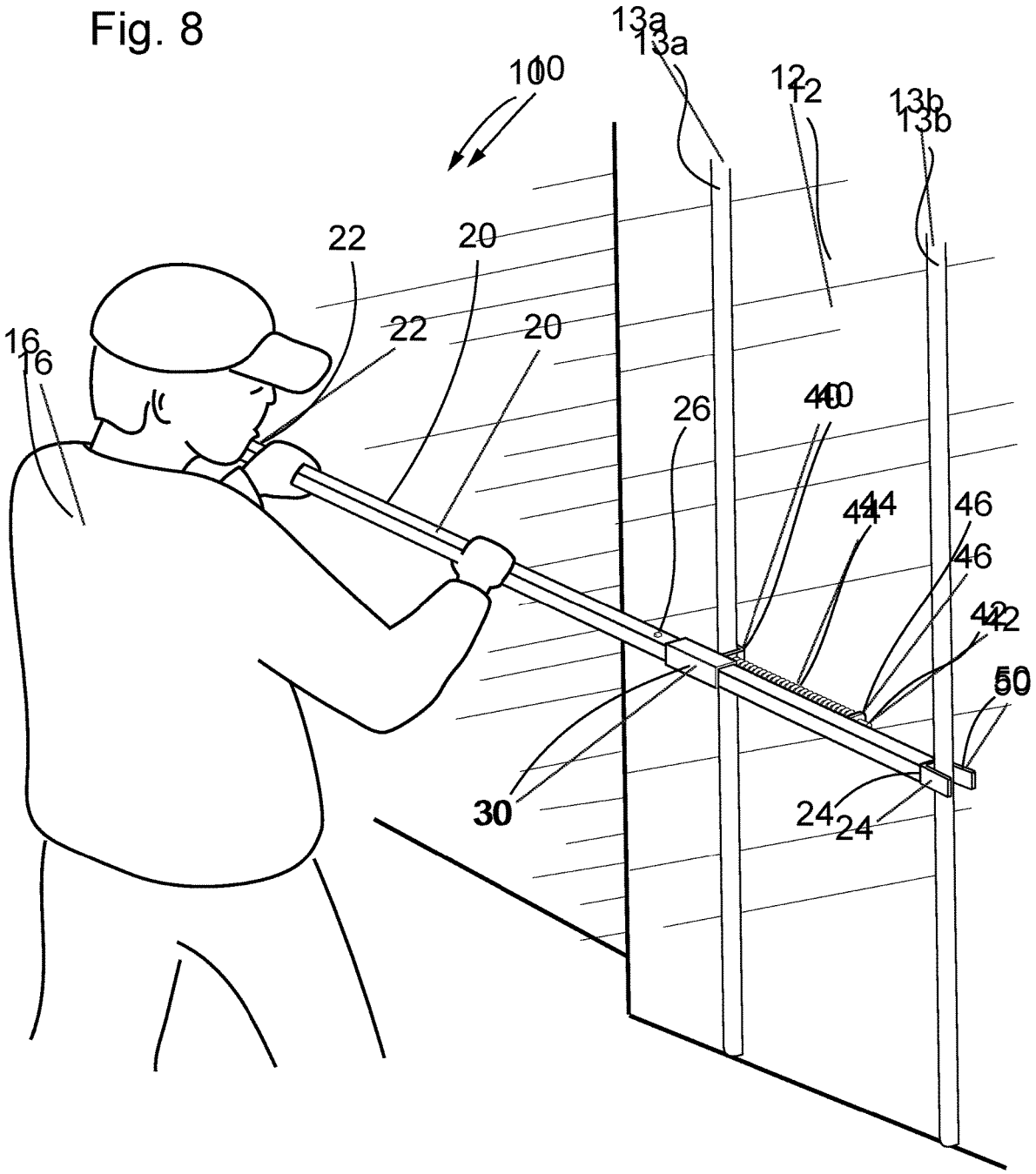
FIG. 8 is a perspective view of a container opener being used to open a container door of a container door opening system in accordance with an example embodiment.

Generally, the first engaging member 40 is comprised of a movable member which is oriented towards the first end 22 of the elongated member 20. Similarly, the second engaging member 50 is generally comprised of a fixed member which is oriented in the opposite direction of the first engaging member 40 (e.g., towards the second end 24 of the elongated member 20). In this manner, the first engaging member 40 may engage with a first anchor point 13*a* on the container door 12 and the second engaging member 50 may engage with a second anchor point 13*b* on the container door 12 such as shown in FIG. 8.

C. Operation of Preferred Embodiment

FIGS. 5-8 illustrate the container door opening system 10 in use to pry open a container door 12 of a container 11. It should be appreciated that the systems and methods described herein may be utilized with a wide range of containers 11 and thus should not be construed as limited for use with standard intermodal shipping containers. Further, the type of access door to be opened may vary in different embodiments.

Generally, a container door 12 will include a pair of anchor points 13*a*, 13*b* to which the first and second engaging member 40, 50 may be engaged to provide leverage to pry open the container door 12. It is common for container doors 12 to include vertical posts or the like, such as shown in FIGS. 5-8, which may serve as anchor points 13*a*, 13*b* for the engaging members 40, 50, with the first engaging member 40 engaging with the first anchor point 13*a* (e.g., a first vertical pipe close to the door side) and the second engaging member 50 engaging with the second anchor point 13*b* (e.g., a second vertical pipe closer to the hinge side). FIGS. 5-8 illustrate exemplary anchor points 13*a*, 13*b* comprised of such vertical pipes or posts.

In use, the container door opening system 10 may be utilized to pry open a wide range of container doors 12 on a wide range of different types of containers 11. Although not shown, the container 11 could comprise various structures including free-standing structures such as intermodal shipping containers, sheds, houses, buildings, or the like. Thus, the systems and methods described herein should not be construed as limited for use with intermodal shipping containers, as the systems and methods could equally be applied to various other types of containers 11, such as but not limited to buildings such as sheds and the like.

The cause of the need for the container door opening system 10 may vary in different embodiments. For example, the hinge on the container door 12 may have been affected by repeated exposure to elements such as wind, rain, sand, dirt, or the like. In other embodiments, the container door 12 may be rusted shut. In yet other embodiments, the container door 12 may have warped due to repeated exposure to different temperatures. In any case, the container door opening system 10 may be utilized to aid in prying open such container doors 12.

In use, the elongated member 20 is first grasped by the operator 16. Generally, the operator 16 will place her first hand at or near the first end 22 of the elongated member 20 which serves as a handle. The operator 16 will place her second hand at another location along the length of the elongated member 20, generally in a position that is closer to the second end 24 of the elongated member 20 than the position of the first hand.

With the elongated member 20 grasped by the operator 16, the elongated member 20 may be positioned near the container door 12 to be opened. The first engaging member 40 is positioned so as to engage with a first anchor point 13*a* on the container door 12. In the exemplary embodiment shown in FIG. 5, the first engaging member 40 is positioned so as to engage with a first vertical pipe which serves as the first anchor point 13*a* on the container door 12.

Figure 5:
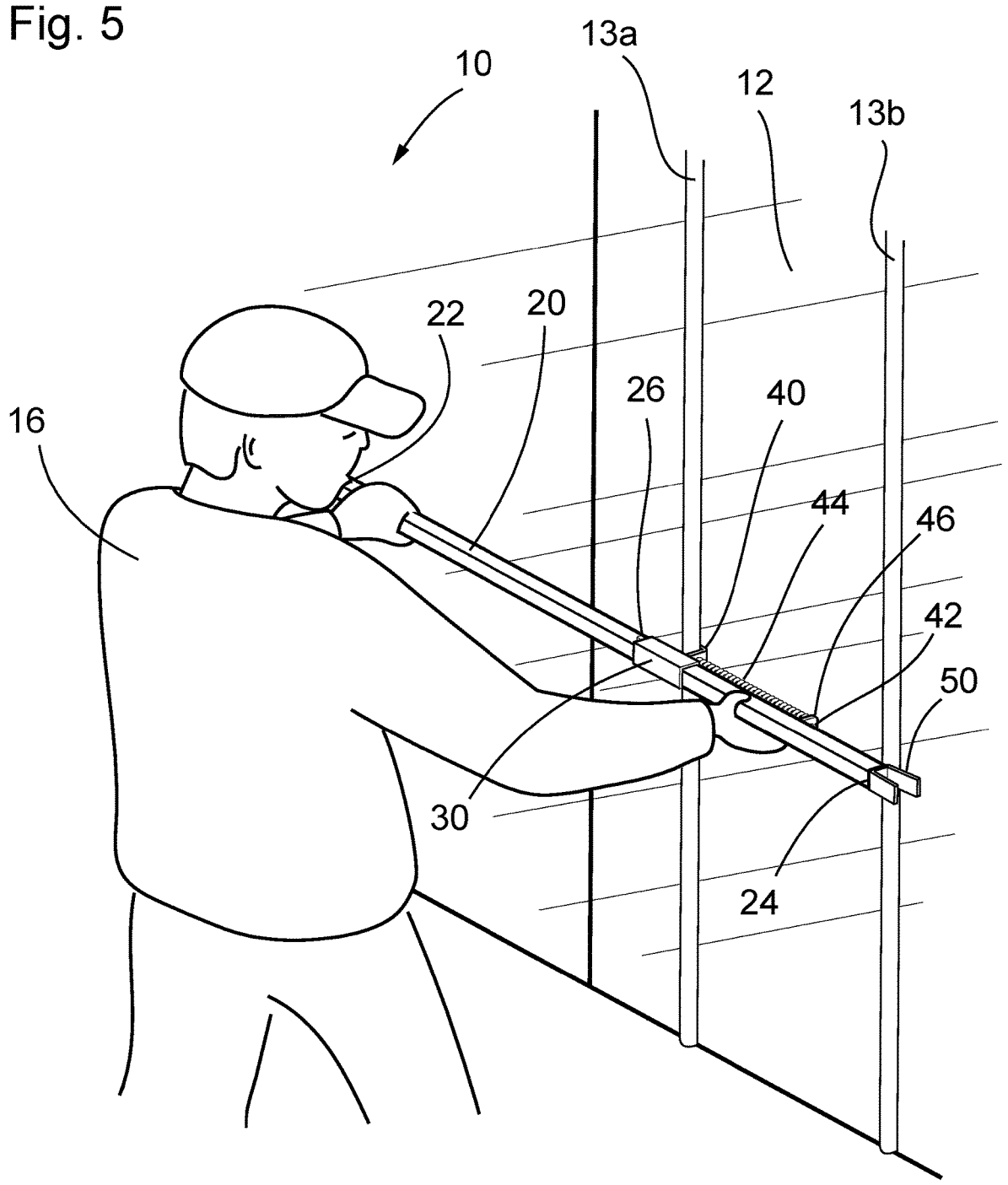
FIG. 5 is a perspective view of a container opener being installed against a container door of a container door opening system in accordance with an example embodiment.

Continuing to reference FIG. 5, the operator 16 first positions the first engaging member 40 such that its jaw engages around the first anchor point 13*a*. At this stage, the second engaging member 40 is still at a point which is past the second anchor point 13*b*. Thus, the operator 16 needs to minimize the effective distance between the first and second engaging members 40, 50 to allow the engaging members 40, 50 to engage between the first and second anchor points 13*a*, 13*b*.

Figure 6:
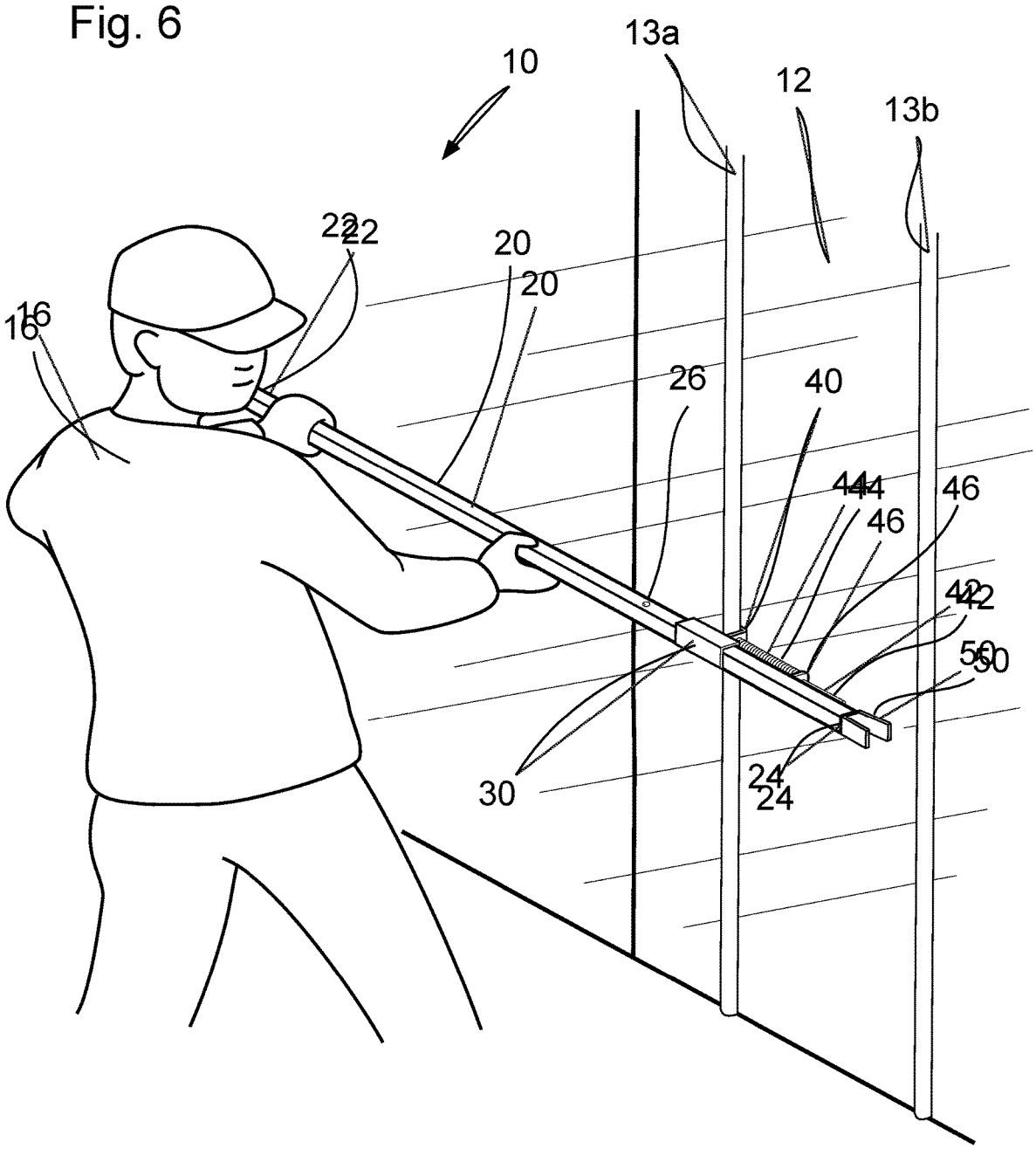
FIG. 6 is a perspective view of a container opener being installed against a container door of a container door opening system in accordance with an example embodiment.

With reference to FIG. 6, the operator 16 may then draw or pull the elongated member 20 in the first direction towards the first end 22 of the elongated member 20. In doing so, the first engaging member 40 is pressed against the first anchor point 13*a* to which it is engaged, causing the bias member 44 to compress and the rod 42 to extend through the bracket 46. This results in the first engaging member 40 being moved towards the second engaging member 50, thus minimizing the distance between the pair of engaging members 40, 50.

With the elongated member 20 so adjusted, the second engaging member 50 may be aligned to engage with the second anchor point 13*b*, which is typically a vertical pipe which is positioned at or near the hinge side of the container door 12, opposite to the first anchor point 13*a*. With the second engaging member 50 so aligned, the operator 16 may release pressure or force upon the elongated member 20. The bias member 44 thus decompresses which causes the distance between the first and second engaging members 40, 50 to enlarge. In other words, the first engaging member 40 is force back to its original, resting (extended) position which, in turn, forces the second engaging member 50 outwardly away from the first engaging member 40. In this manner, the second engaging member 50 engages with the second anchor point 13*b* such as shown in FIG. 7.

Figure 7:
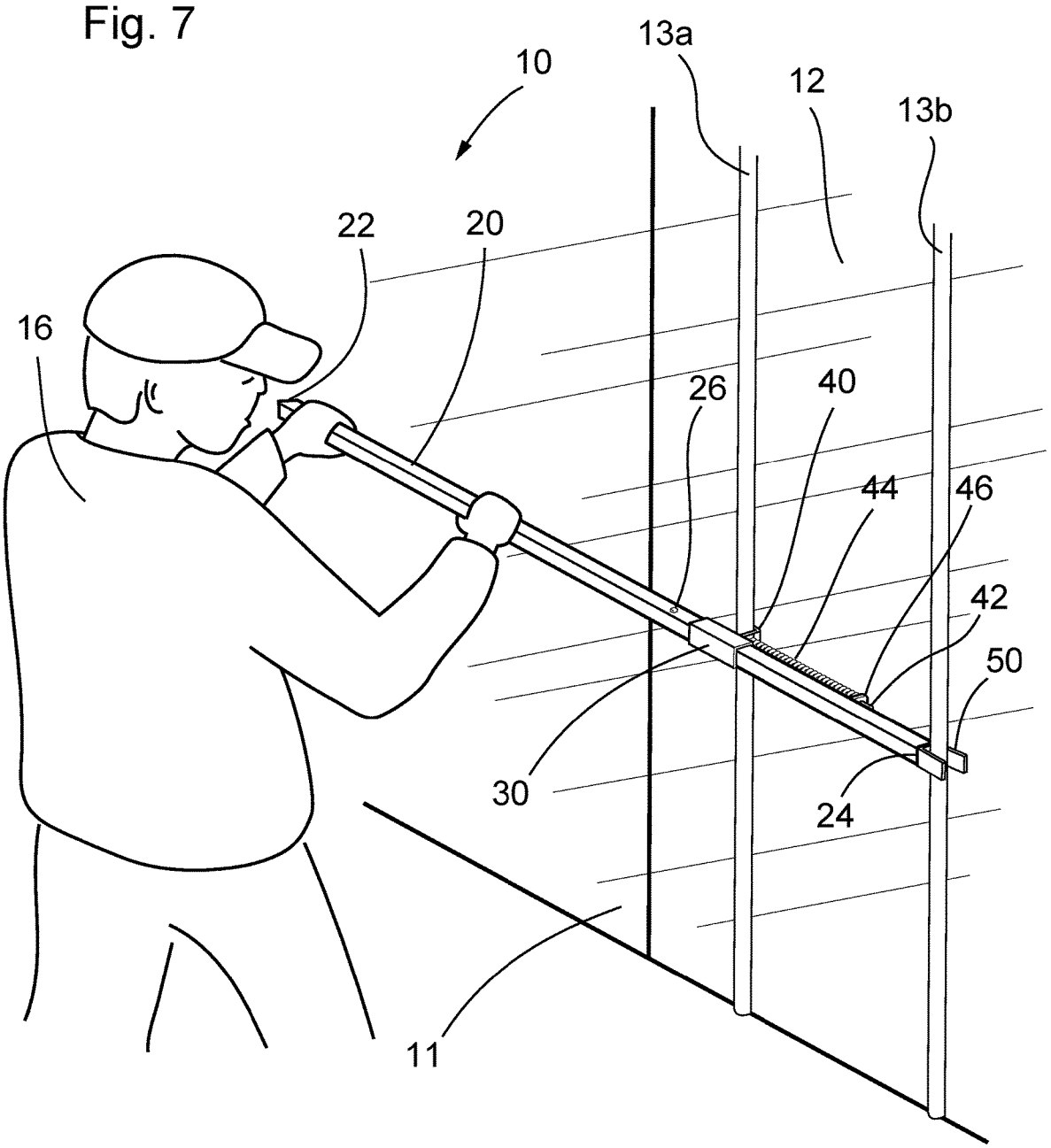
FIG. 7 is a perspective view of a container opener being installed against a container door of a container door opening system in accordance with an example embodiment.

As shown in FIG. 7, the elongated member 20 is secured between a pair of anchor points 13*a*, 13*b* on a container door 12, with the first engaging member 40 being engaged with the first anchor point 13*a* and the second engaging member 50 being engaged with the second anchor point 13*b*. The operator 16 may then grasp the elongated member 20, such as at or near its first end 22, to apply a prying, rotational force. The elongated member 20 is pivoted about the second engaging member 50, thus causing force to be exerted by the first engaging member 40 on the first anchor point 13*a* which is opposite to the hinge. This causes the container door 12 to be pried open, relying upon leverage provided by the elongated member 20, such as shown in FIG. 8.

After opening the container door 12, the elongated member 20 may be removed by compressing the bias member 44 such that the first engaging member 40 is drawn toward the second engaging member 50 so as to reduce the distance between the engaging members 40, 50. This functions to release the second engaging member 50 from the second anchor point 13*b* so that the elongated member 20 may be fully removed from the container door 12 for further use. Alternatively, the elongated member 20 may be kept on the container door 12 and used to close the container door 12 by pivoting in the opposite direction prior to removal of the elongated member 20.

Unless otherwise defined, all technical and scientific terms used herein have the same meaning as commonly understood by one of ordinary skill in the art to which this invention belongs. Although methods and materials similar to or equivalent to those described herein can be used in the practice or testing of the container door opening system, suitable methods and materials are described above. All publications, patent applications, patents, and other references mentioned herein are incorporated by reference in their entirety to the extent allowed by applicable law and regulations. The container door opening system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A container door opening system, comprising:

an elongated member comprising a first end and a second end;

a connector movably connected to the elongated member, wherein the connector is movable towards and away from the second end of the elongated member;

a first engaging member connected to the connector, wherein the first engaging member is adjustable between a first position and a second position, wherein the first position comprises a retracted position and wherein the second position comprises an extended position;

a bracket connected to the elongated member between the connector and the second end of the elongated member;

a bias member connected between the bracket and the first engaging member so as to bias the first engaging member towards the first end of the elongated member; and a second engaging member connected at or near the second end of the elongated member, wherein the first engaging member is closer to the second engaging member in the retracted position than in the extended position;

wherein the first engaging member and the second engaging member are each adapted to engage with a container door so as to open or close the container door, and wherein the first engaging member is adapted to engage with a first anchor point on the container door and wherein the second engaging member is adapted to engage with a second anchor point on the container door.

2. The container door opening system of claim 1, wherein the first anchor point is comprised of a first vertical pipe and wherein the second anchor point is comprised of a second vertical pipe.

3. The container door opening system of claim 1, wherein the connector is comprised of a sleeve.

4. The container door opening system of claim 3, wherein the sleeve completely surrounds the elongated member.

5. The container door opening system of claim 1, wherein the first engaging member is comprised of an L-shaped member oriented in a first direction and wherein the second engaging member is comprised of a U-shaped member oriented in a second direction, wherein the first direction is opposite to the second direction.

6. A method of opening a container door with the container door opening system of claim 1, comprising the steps of:

engaging the first engaging member with a first anchor point on the container door;

pulling the elongated member so as to retract the first engaging member into the retracted position;

aligning the second engaging member with a second anchor point on the container door;

releasing the elongated member so as to extend the first engaging member into the extended position;

engaging the second engaging member with the second anchor point on the container door; and moving the elongated member away from the container door so as to open the container door.

7. A method of closing a container door with the container door opening system of claim 1, comprising the steps of:

engaging the first engaging member with a first anchor point on the container door;

pulling the elongated member so as to retract the first engaging member into the retracted position;

aligning the second engaging member with a second anchor point on the container door;

releasing the elongated member so as to extend the first engaging member into the extended position;

engaging the second engaging member with the second anchor point on the container door; and moving the elongated member towards the container door so as to close the container door.

8. A method of using a container door opener device for opening or closing a container door, wherein the container door opener device comprises an elongated member comprising a first end and a second end, a first engaging member movably connected to the elongated member, wherein the first engaging member is adjustable in a first direction towards the first end of the elongated member and in a second direction towards the second end of the elongated member, wherein the first engaging member is adjustable between a first position and a second position, wherein the first position is comprised of a retracted position and wherein the second position is comprised of an extended position, a second engaging member connected at or near the second end of the elongated member, wherein the first engaging member is closer to the second engaging member in the retracted position than in the extended position, a bracket connected to the elongated member between the first engaging member and the second engaging member, and a bias member connected between the bracket and the first engaging member so as to bias the first engaging member towards the extended position, wherein the first engaging member and the second engaging member are each adapted to engage with a container door so as to open or close the container door, the method comprising:

engaging the first engaging member with a first anchor point on the container door;

pulling the elongated member so as to retract the first engaging member into the retracted position;

aligning the second engaging member with a second anchor point on the container door;

releasing the elongated member so as to extend the first engaging member into the extended position;

engaging the second engaging member with the second anchor point on the container door; and moving the elongated member away from or towards the container door so as to open or close the container door.

9. The method of claim 8, wherein the bias member is comprised of a coiled spring.

10. The method of claim 8, wherein the first engaging member is oriented in a first direction and wherein the second engaging member is oriented in a second direction.

11. The method of claim 8, wherein the first engaging member comprises an L-shaped member.

12. The method of claim 8, wherein the second engaging member comprises a U-shaped member.

13. A container door opening system, comprising:

an elongated member comprising a first end and a second end;

a first engaging member movably connected to the elongated member, wherein the first engaging member is adjustable between a first position and a second position, wherein the first position comprises a retracted position and wherein the second position comprises an extended position;

a bias member connected to the first engaging member so as to bias the first engaging member towards the first end of the elongated member; and a second engaging member connected at or near the second end of the elongated member, wherein the first engaging member is closer to the second engaging member in the retracted position than in the extended position;

wherein the first engaging member is adapted to engage with a first anchor point on a container door and wherein the second engaging member is adapted to engage with a second anchor point on the container door.

14. The container door opening system of claim 13, wherein the first anchor point is comprised of a first vertical member and wherein the second anchor point is comprised of a second vertical member.

15. The container door opening system of claim 13, wherein the first engaging member is movably connected to the elongated member by a sleeve that is slidably connected to the elongated member.

16. The container door opening system of claim 15, wherein the sleeve completely surrounds the elongated member.

17. The container door opening system of claim 13, wherein the first engaging member is comprised of an L-shaped member oriented in a first direction and wherein the second engaging member is comprised of a U-shaped member oriented in a second direction, wherein the first direction is opposite to the second direction.

18. The container door opening system of claim 13, further comprising a rod connected to the first engaging member, wherein the bias member is comprised of a spring coiled around the rod.

19. A method of opening a container door with the container door opening system of claim 13, comprising the steps of:

engaging the first engaging member with a first anchor point on the container door;

pulling the elongated member so as to retract the first engaging member into the retracted position;

aligning the second engaging member with a second anchor point on the container door;

releasing the elongated member so as to extend the first engaging member into the extended position;

engaging the second engaging member with the second anchor point on the container door; and moving the elongated member away from the container door so as to open the container door.

20. A method of closing a container door with the container door opening system of claim 1, comprising the steps of:

engaging the first engaging member with a first anchor point on the container door;

pulling the elongated member so as to retract the first engaging member into the retracted position;

aligning the second engaging member with a second anchor point on the container door;

releasing the elongated member so as to extend the first engaging member into the extended position;

engaging the second engaging member with the second anchor point on the container door; and moving the elongated member towards the container door so as to close the container door.

* * * * *